United States Patent [19]

Tsuchiya et al.

[11] Patent Number: 4,498,415

[45] Date of Patent: Feb. 12, 1985

[54] DETECTION OF IMPROPER COATING OF SEALING COMPOSITION ON CAN END DISKS

[75] Inventors: Toshiharu Tsuchiya, Susono; Mamoru Iwata, Oyama, both of Japan

[73] Assignee: Shinryo Seikan Kabushiki Kaisha, Tokyo, Japan

[21] Appl. No.: 545,357

[22] Filed: Oct. 25, 1983

[30] Foreign Application Priority Data

Nov. 19, 1982 [JP] Japan ..... 57-202028

[51] Int. Cl.[3] ..... B05C 3/02; B05B 13/06

[52] U.S. Cl. ..... 118/712; 118/670; 118/318; 118/409; 427/10

[58] Field of Search ..... 118/670, 676, 682, 684, 118/712, 62, 318, 320, 408, 409, 416; 425/809; 427/10, 233, 207.1, 425

[56] References Cited

U.S. PATENT DOCUMENTS

| | | | |
|---|---|---|---|
| 2,795,818 | 6/1957 | Bertorello et al. | 118/684 |
| 3,396,698 | 8/1968 | Alholm et al. | 118/318 |
| 3,898,954 | 8/1975 | Galitz | 118/670 |

*Primary Examiner*—Norman Morgenstern

*Assistant Examiner*—K. Jaconetty

*Attorney, Agent, or Firm*—Stevens, Davis, Miller & Mosher

[57] ABSTRACT

Can end disks have annular, curled rims on which a sealing composition is applied as a coat to form airtight seals when the end disks are subsequently attached to can bodies. The sealing composition is sprayed onto the curled rim of each can end disk by an overlying spray nozzle while the disk is being rotated on a rotary rest in a coating machine. For detecting uncoated regions on the curled rim of the can end disk, a photodetector is positioned over the rim of the disk on the rotary rest, with a preassigned angular spacing between the photodetector and the spray nozzle. The detection of uncoated regions is essentially concurrent with the application of the sealing composition. Since the output from the photodetector represents a nonfaulty uncoated region (i.e. a region not yet coated), in addition to a possible faulty uncoated region (i.e. a region accidentally left uncoated), a signal generator such as a proximity detector is provided for invalidating the photodetector output portion representative of the nonfaulty uncoated region. Any can end disk having a faulty uncoated region is rejected while being subsequently conveyed toward the next processing station.

3 Claims, 10 Drawing Figures

DETECTION OF IMPROPER COATING OF SEALING COMPOSITION ON CAN END DISKS

BACKGROUND OF THE INVENTION

This invention is generally in the field of the manufacture of cans for containing perishable foods and a variety of other products in a hermetically sealed state. More specifically the invention concerns a method of, and means for, detecting uncoated regions in the annular coatings of sealing composition on can end disks preparatory to their attachment to can bodies.

The sanitary can in general is made up of a body and a pair of end disks closing its opposite ends. The can body is side seamed and flanged at both ends. The end disks have curled peripheral rims which are coated with a sealing composition. When the can body flanges and end disk rims are machine folded together, the composition provides a tight, gasketlike seal. The can body is delivered to the food packer or any other filling machine with one end sealed; the other end is sealed when the can is filled. Thus, for hermetically sealing the can ends, it is essential that the sealing composition be applied as a uniform coat on the curled rims of the end disks. The end disks that have been coated improperly with the sealing composition must therefore be detected and rejected prior to attachment to can bodies.

To this end it has been suggested and practiced to mount a pair of light sensitive devices in transversely spaced positions over a conveyor transporting a succession of coated can end disks from the coating station to the next processing station. The pair of light sensitive devices operate conjointly to detect uncoated regions on the curled rims of the can end disks. This conventional practice is unsatisfactory, however. The light sensitive devices over the conveyor can certainly detect can end disks whose rims are totally or half uncoated, but not those having smaller uncoated regions. Passing undetected, the latter kind of end disks are allowed to be attached to can bodies to create cans that are not sealed hermetically.

SUMMARY OF THE INVENTION

The present invention makes possible the unfailing detection of can end disks that are not coated properly with a sealing composition, no matter how small the uncoated regions may be on the end disks. The invention also assures positive rejection of the improperly coated end disks following the detection thereof.

According to one aspect of the invention there is provided a method of detecting improper coating of a sealing composition on annular, curled rims of can end disks. The method comprises providing a coating machine comprising a rotary rest for holding one can end disk at a time for joint rotation therewith, and a nozzle supported in a peripheral position over the can end disk on the rest for applying the sealing composition on the curled rim of the can end disk while the latter is in rotation with the rest. An uncoated region, if any, on the curled rim of the can end disk on the rest is detected by a photodetector, disposed in another peripheral position thereover, while the can end disk is in rotation with the rest and is being coated with the sealing composition from the nozzle. The output from the photodetector is of course utilized for rejecting any can end disk having an uncoated region thereon.

Another aspect of the invention concerns, in apparatus for applying as a coating a sealing composition on annular, curled rims of can end disks, a mechanism for detecting improper coating of the sealing composition on the disk rims. The coating apparatus has a rotary rest for holding thereon one can end disk at a time for joint rotation therewith, and a nozzle disposed in a peripheral position over the can end disk on the rest for dispensing each metered quantity of the sealing composition, so that the sealing composition can be applied as a coating from the nozzle on the curled rim of each can end disk while the latter is in rotation on the rest. The detection mechanism comprises a photodetector disposed in another peripheral position over the can end disk on the rest for detecting an uncoated region, if any, on the curled rim of the can end disk on the rest while the can end disk is being rotated with the rest and being coated with the sealing composition from the nozzle. Also included are rejection means responsive to the output from the photodetector for rejecting any can end disk having an uncoated region thereon.

Thus the invention suggests the detection of any uncoated region on the curled rim of a can end disk while the latter is in rotation to be coated with a sealing composition, instead of while the disk is being transported by a conveyor after having been coated as in the prior art. It is therefore apparent that the single photodetector in use can unfailingly detect any uncoated region no matter how small it may be. Moreover, as will become apparent as the description progresses, the complete process from the detection of an uncoated region to the rejection of the defective can end disk lends itself to easy automation.

The above and other features and advantages of this invention and the manner of realizing them will become more apparent, and the invention itself will best be understood, from a study of the following description and appended claims, with reference had to the attached drawings showing an exemplary embodiment of the invention.

DETAILED DESCRIPTION OF THE INVENTION

Figure 1:
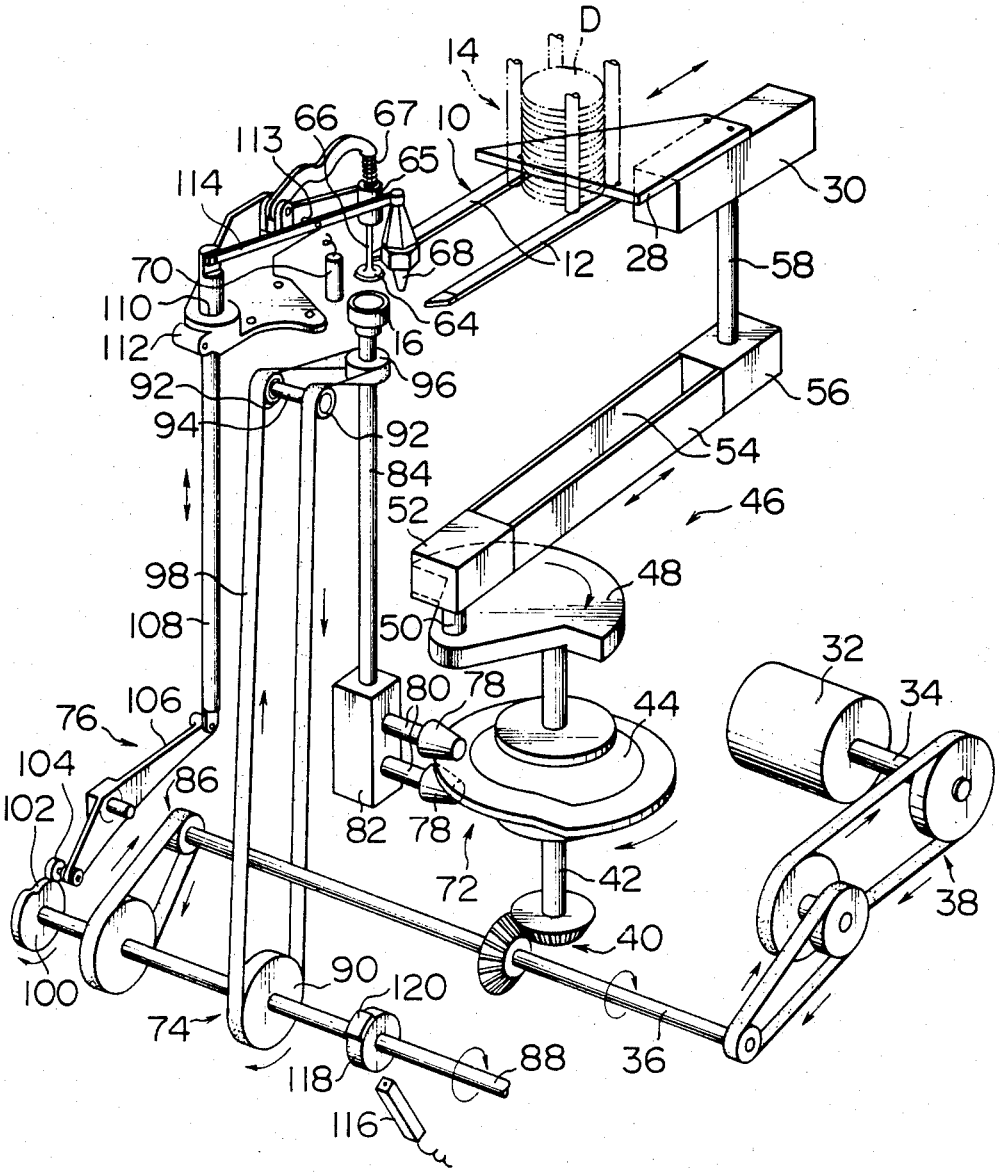
FIG. 1 is a schematic perspective view of apparatus for applying as a coating a sealing composition on curled rims of can end disks, the apparatus incorporating the means for detecting improper coating of the sealing composition in accordance with the principles of the present invention.

The general organization of the exemplified coating machine will become apparent from a consideration of FIG. 1. It includes a feed mechanism 10 having a pair of reciprocating feed bars 12 for feeding successive can end disks D from holder means 14 to a rotary rest 16. Each can end disk D is to have its curled annular rim coated with a standard sealing composition while being revolved on the rest 16.

Figure 2:
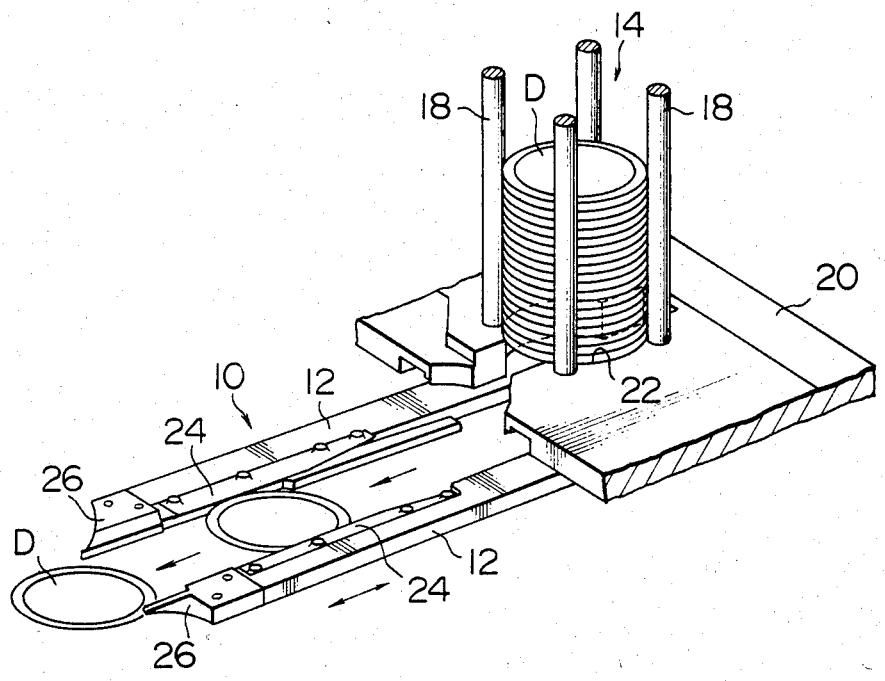
FIG. 2 is a relatively enlarged perspective view showing the can end disk holder means and feed means in the apparatus of FIG. 1.

As better seen in FIG. 2, the holder means 14 comprises four upstanding holder rods 18 planted at constant angular spacings on a support plate 20. The uncoated can end disks D are stacked up in the space bounded by the four holder rods 18. The support plate 20 has an aperture 22 formed therein to allow the stack of can end disks D to pass downwardly therethrough.

FIG. 2 also illustrates the pair of feed bars 12 in further detail. Disposed under the support plate 20, the feed bars 12 extend horizontally and in parallel spaced relation to each other toward the rotary rest 16 of FIG. 1. The feed bars 12 have a pair of separator blades 24 fixedly and replaceably mounted on and along their opposed inner edges. These separator blades 24 are adapted to enter between the lowermost and the immediately overlying end disks of the stacked can end disks D and, with the forward stroke of the feed bars 12, to separate the lowermost can end disk from the stack, thereby making it possible for the feed bars to carry only the lowermost can end disk over to the rotary rest 16. Formed at the forward tips of the feed bars 12 are a pair of push fingers 26 for thrusting the successive coated can end disks from over the rotary rest 16 onto a delivery conveyor yet to be described.

With reference back to FIG. 1 the feed bars 12 at their rear ends are rigidly coupled to a connector plate 28, which in turn is secured to a slide 30. This slide is slidable along guide means, not shown, and is thereby constrained to linear travel in the direction indicated by the double headed arrow in FIG. 1.

In order to drive the slide 30 and therefore the feed bars 12, as well as the rotary rest 16 and other parts hereinafter described, a motor drive unit is provided at 32. The motor drive unit 32 has an output shaft 34 coupled to a drive shaft 36 via any suitable drive mechanism such as a belt and pulley arrangement 38. The drive shaft 36 is coupled via bevel gearing 40 to the bottom end of an upstanding camshaft 42 having a lift cam 44 fixedly mounted thereon in a position intermediate between its opposite ends. The lift cam 44 functions to impart up-and-down motion to the rotary rest 16, as will be detailed presently. The camshaft 42 is connected to the slide 30 via a crank mechanism generally designated 46. The crank mechanism 46 includes a crank 48 fixedly mounted on the top end of the camshaft 42, which could be termed a crankshaft if the lift cam 44 were not mounted thereon. The crank 48 has an offset crankpin 50 planted thereon. The crankpin 50 is rotatably coupled to an end block 52 at one end of a pair of connecting plates 54. At the other end of the connecting plate pair 54, there is another end block 56 connected by a rod 58 to the slide 30. The connecting rod 58 must be rotatable relative to at least either of the slide 30 and connecting plate end block 56.

Thus, as the motor drive unit output shaft 34 rotates, so does the camshaft 42. The crank mechanism 46 functions to translate the rotation of the camshaft 42 into the linear reciprocation of the slide 30 and, in consequence, of the feed bars 12. The reciprocating feed bars 12 feed the can end disks D from the holder means 14 onto the rotary rest 16 one by one, as has been stated in connection with FIG. 2.

The rotary rest 16 is not only rotatable but also movable up and down in timed relation to the reciprocation of the feed bars 12. Held in constant rotation, the rest 16 receives each can end disk D thereon while in a lowered position and is then cammed upwardly together with the can end disk.

Figure 3:
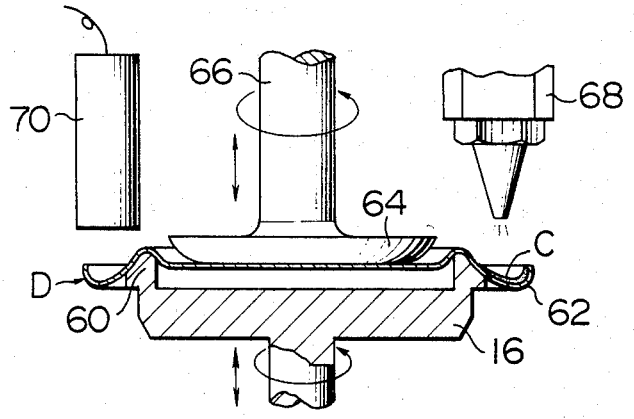
FIG. 3 is a further enlarged elevation, partly in vertical section, showing a can end disk in the act of being simultaneously coated with the sealing composition and having an uncoated region thereon detected in the apparatus of FIG. 1.

As shown on an enlarged scale in FIG. 3, the rotary rest 16 is in the form of a disk with a raised annular rim 60 of a shape and size to neatly receive the can end disk D thereon. The can end disk D has a curled annular rim 62 projecting beyond the raised rim 60 of the rotary rest 16.

Disposed coaxially with and immediately over the rotary rest 16 is a holddown 64 in the shape of a disk with a diameter less than that of the rest. The holddown 64 is formed on the bottom end of an upright stem 66 for rotation therewith and further for up-and-down motion therewith in a stationary sleeve 65 in step with the vertical motion of the rotary rest 16. A coil spring 67 is disposed around the stem 66 to urge it downwardly. When the rest is raised with the can end disk D thereon until the disk abuts against the holddown 64 against the force of the spring 67, the holddown 64 presses the disk against the rest to cause the joint rotation of the disk with the rest and with the holddown itself.

FIG. 3 also clearly reveals a spray nozzle 68 and a photodetector 70 immovably supported in preassigned angular positions over the curled rim 62 of the can end disk D on the rest 16. The spray nozzle 68 has a built-in needle valve, not shown, for spraying each predetermined quantity of a sealing composition onto the curled rim 62 of the can end disk D while the latter is being rotated a prescribed number of revolutions by being caught between rest 16 and holddown 64. At C in FIG. 3 is shown a coating of the sealing composition thus formed by the spray nozzle 68 on the curled rim of the can end disk D.

Constituting one of the most pronounced features of this invention, the photodetector 70 is angularly spaced 180 degrees from the spray nozzle 68 about the axis of rotation of the can end disk D on the rest 16. While the spray nozzle 68 is spraying the sealing composition onto the curled rim 62 of the revolving can end disk D, the photodetector 70 operates at the same time to detect any uncoated region on the can end disk rim. Basically the photodetector 70 can be of any known or suitable design capable of sensing such an uncoated region from the difference in reflectivity between the coated and uncoated regions. Of course, since the can end disk D is of metal such as aluminum, the uncoated region is more reflective than the coating of the sealing composition.

Reference is again directed back to FIG. 1 in order to explain a lift cam mechanism 72 for moving the rest 16 up and down, a timing belt drive mechanism 74 for constantly rotating the rest, and a nozzle control mechanism 76 for opening and closing the spray nozzle 68.

The lift cam mechanism 72 includes the aforesaid lift cam 44 on the camshaft 42. In rolling engagement with the opposite sides of the lift cam 44 are a pair of cam follower rolls 78 on the distal ends of respective cantilever shafts 80. These cantilever shafts are rotatably supported at their proximal ends by a coupling 82 which is constrained to vertical sliding motion by guide means, not shown. An upstanding rest shaft 84, with the rest 16 nonrotatably mounted on its top end, is rotatably supported at its bottom end in the coupling 82 and so is operatively coupled to the cam follower rolls 78. The lift cam 44 is of course contoured to cause the up-and-down motion of the cam follower rolls 78 with the rotation of the motor driven camshaft 42. Consequently the rest 16 travels up and down interrelatedly with the horizontal reciprocation of the feed bars 12, the latter being also driven from the camshaft 44 via the crank mechanism 46.

The drive shaft 36 is coupled via a belt drive 86 to a second drive shaft 88 parallel to the first recited drive shaft 36. The timing belt drive mechanism 74 functions to transmit the rotation of the second drive shaft 88 to the rest shaft 84. Included therein are a drive pulley 90 on the second drive shaft 88, a pair of guide pulleys 92 on a common shaft 94, and a driven pulley 96 on the rest shaft 84. A timing belt 98 extends around these pulleys 90, 92 and 96. All of the pulleys are, of course, grooved to mesh with the usual cogs on the timing belt 98. Thus, driven by the motor drive unit 32 via the drive shafts 36 and 88 and timing belt drive mechanism 74, the rest 16 is in constant rotation during the operation of the apparatus.

The nozzle control mechanism 76 includes a nozzle cam 100 fixedly mounted on the second drive shaft 88. The nozzle cam 100 takes the form of a disk with a peripheral cutout 102. In rolling contact with this contoured periphery of the nozzle cam 100 is a cam follower roll 104 rotatably supported on the outer end of one arm of a bell crank 106. The other arm of the bell crank 106 is pin jointed to the bottom end of an upstanding link 108 slidably extending through a bore 110 in a fixed support 112. The top end of the link 108 is pin jointed to one end of a nozzle lever 114. The other end of the nozzle lever 114, which is pivoted medially at 113, is operatively coupled to a needle valve (not shown) built into the spray nozzle 68.

The cam follower roll 104 is pressed by a spring against the contoured periphery of the nozzle cam 100 to cause the up-and-down motion of the upstanding link 108 with the constant speed rotation of the second drive shaft 88. Upon downward displacement of the link 108, the needle valve opens the spray nozzle 68, thereby allowing the same to spray the sealing composition onto the curled rim of the can end disk D on the rotary rest 16. The upward displacement of the link 108 results in the closure of the spray nozzle 68 by the needle valve.

As has been stated, the photodetector 70 is angularly spaced 180 degrees from the spray nozzle 68 about the axis of rotation of the can end disk D on the rotary rest 16 in the illustrated embodiment. By reason of this angular positioning of the photodetector 70 with respect to the spray nozzle 68, the exemplified detection system requires another signal generator for a purpose to be made apparent presently.

The signal generator is a proximity detector seen at 116 in FIG. 1. The proximity detector 116 is positioned close and oriented toward a lobed wheel 118 mounted on the second drive shaft 88 for joint rotation therewith. Whenever a lobe 120 on the wheel 118 comes opposite to the proximity detector 116, the latter produces an electrical signal. The second drive shaft 88 is in constant rotation during the operation of the coating machine, so that the proximity detector 116 puts out the signal at constant time intervals. More will be said later about the electrical details of the detection system.

Figure 4:
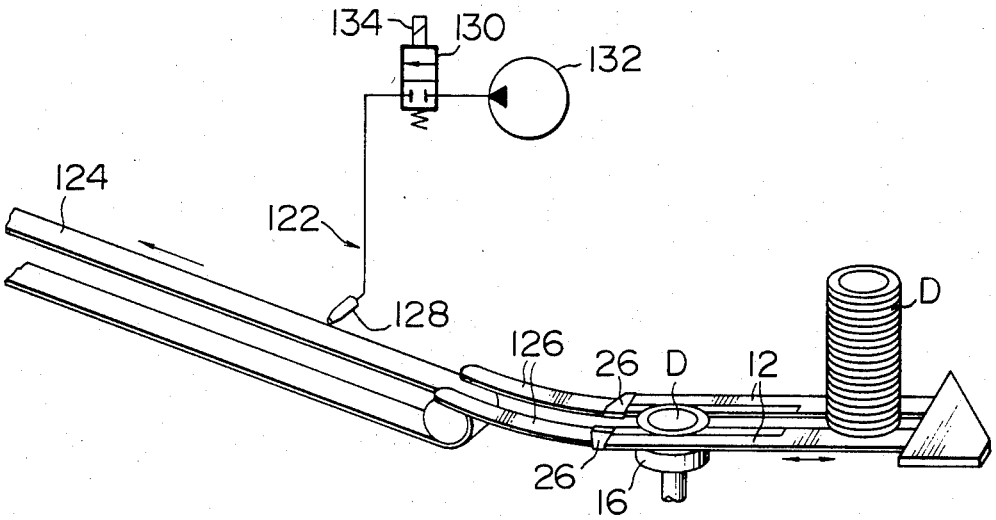
FIG. 4 is a schematic perspective view showing, together with some pertinent parts of the FIG. 1 apparatus, a delivery conveyor for transporting the successive coated end disks to a subsequent processing station, and rejection means for removing any improperly coated end disk from the delivery conveyor.

In FIG. 4 are shown rejection means 122 for rejecting any detected can end disk on which the sealing composition has been coated improperly. This particular embodiment dictates the rejection of faulty can end disks on their way from the illustrated coating machine to a subsequent processing station.

Thus the rejection means 122 are shown provided for a delivery conveyor 124 extending from the coating station toward the next processing station. After having been coated with the sealing composition on the rotary rest 16, the successive can end disks D are pushed by the pair of push fingers 26 (FIG. 2) of the feed bars 12 onto the loading end of the delivery conveyor 124. A pair of guide rails 126 extend from the rotary rest 16 to the loading end of the delivery conveyor 124 to allow the can end disks to slide thereover while being pushed by the push fingers of the feed bars 12.

The rejection means 122 include an air nozzle 128 positioned on one side of the delivery conveyor 124 for expelling a forced stream of air across the same. A solenoid operated on-off valve 130 selectively places the air nozzle 128 in and out of communication with a source 132 of air under pressure. Upon energization of the solenoid 134 on the on-off valve 130, the air nozzle 128 blows the faulty can end disk away from atop the delivery conveyor 124.

Figure 5:
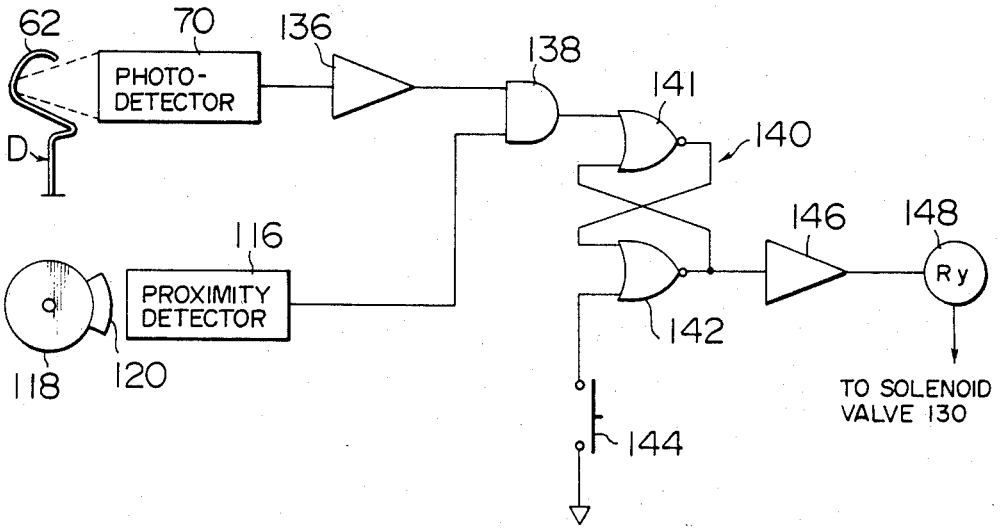
FIG. 5 is a block diagram of electronic circuitry for use in the detection system of this invention.

FIG. 5 is a block diagrammatic representation of the electronic circuitry for use in or with the detection system of the invention. The circuitry comprises the photodetector 70 over the curled rim 62 of the can end disk D being coated with the sealing composition on the rotary rest, and the proximity detector 116 confronting the lobed wheel 118 on the second drive shaft. The photodetector 70 is connected via an amplifier 136 to one of the two input terminals of an AND gate 138, whereas the proximity detector 116 is connected directly to the other input terminal of the AND gate.

The output of the AND gate 138 is connected to a holding circuit 140 comprising first and second NOR circuits 141 and 142. The first NOR circuit 141 has a first input terminal connected to the output side of the AND gate 138, a second input terminal connected to the output side of the second NOR circuit 142, and an output terminal connected to a first input terminal of the second NOR circuit. The second NOR circuit 142 has a second input terminal connected to a reset switch 144. The output side of the second NOR circuit 142 is connected via an output amplifier 146 to a relay 148, besides being connected to the second input terminal of the first NOR circuit 141. The actuation of the relay 148 by the output from the output amplifier 146 results in the energization of the solenoid 134 (FIG. 4) and in the consequent opening of the on-off valve 130.

OPERATION

The operation of the coating apparatus, with particular emphasis on that of the detection system incorporated therewith, will be best understood by referring to FIGS. 6A through 6E. The following operational description is meant also as a detailed disclosure of the inventive method.

Figures 6A, 6B, 6C, 6D, 6E:
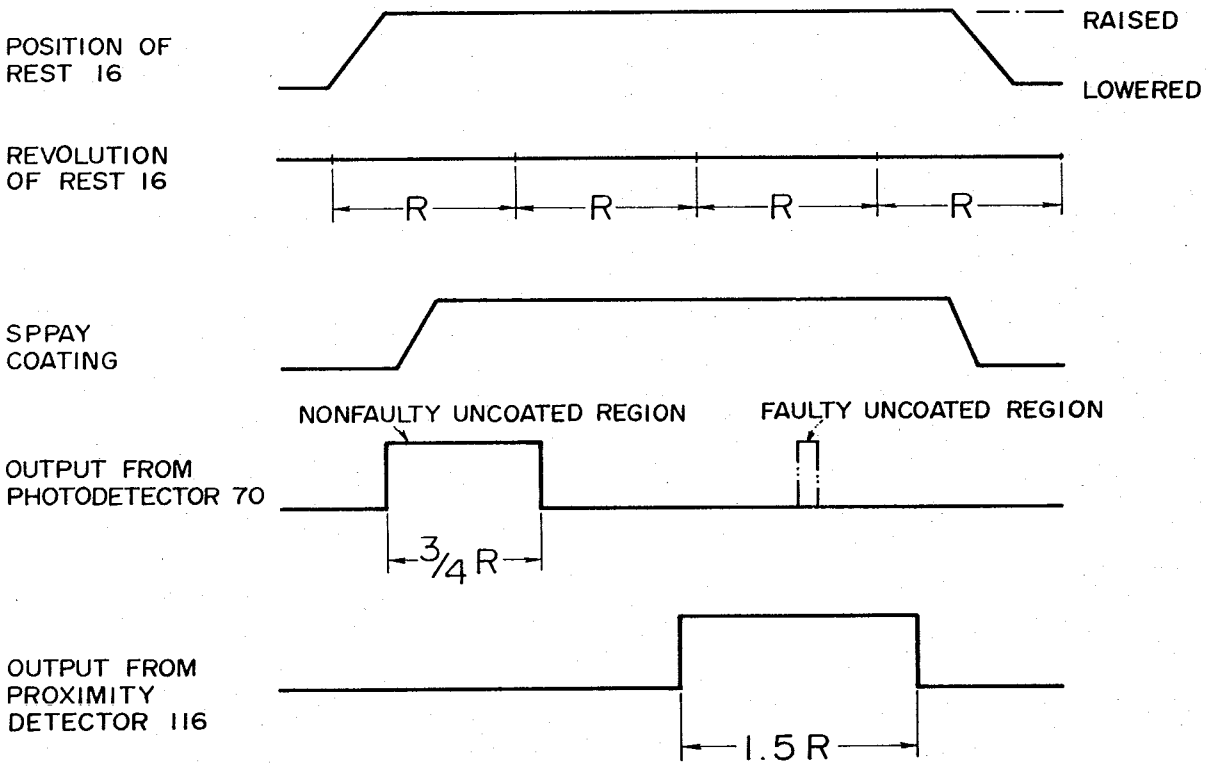
FIGS. 6A through 6E are a series of charts explanatory of the operation of the detection system of this invention.

It will be observed from FIGS. 6A and 6B that the rest 16 travels up and down while in rotation at constant speed. The capital R in FIG. 6B represents one complete revolution of the rest 16. The up and down motion of the rest 16 is produced by the lift cam mechanism 72 (FIG. 1), whereas its constant speed rotation is caused by the timing belt drive linkage 74. Actuated by the crank mechanism 46, the pair of feed bars 12 with the separator blades 24 thereon reciprocate to deliver successive uncoated can end disks D from the holder means 14 onto the rest 16. This rest receives only one can end disk D thereon at a time when in a lowered position and is subsequently raised therewith. In the raised position of the rest 16, the holddown 64 presses the can end disk D against the rest.

As indicated in FIG. 6C, the spray nozzle 68 starts spraying a predetermined quantity of the sealing composition onto the curled rim 62 of the can end disk D shortly after, or nearly concurrently with, the clamping of the disk between rest 16 and holddown 64. The spray coating of the sealing composition continues while the clamped disk makes a prescribed number (e.g., approximately three) of revolutions in the raised position of the rest 16.

The photodetector 70 operates to detect any uncoated region on the curled rim 62 of the can end disk D while the latter is in rotation in the raised position of the rest 16 and is being coated with the sealing composition from the spray nozzle 68. It has been stated that the photodetector 70 is angularly spaced 180 degrees from the spray nozzle 68. Accordingly, during the initial $\frac{3}{4}$ revolution, for example, of the can end disk D, the photodetector puts out a signal indicative of a "nonfaulty uncoated region" on the disk rim, by which is meant the region which is not yet coated with the sealing composition but which will be coated with the continued rotation of the disk. FIG. 6D indicates by the solid lines the photodetector output representative of the nonfaulty uncoated region. The output from the photodetector 70 will thereafter be zero if the sealing composition is applied properly on the curled rim of the revolving can end disk D.

However, should some portion of the disk rim be left uncoated for some reason or other after the initial $\frac{3}{4}$ revolution of the disk, the photodetector 70 will again produce an output representative of the "faulty uncoated region", as indicated in phantom form in FIG. 6D.

Thus the output signal of the photodetector 70 invariably represents the nonfaulty uncoated region and, possibly, a faulty uncoated region or regions on the curled rim of each can end disk. The signal portion representative of the nonfaulty uncoated region must therefore be invalidated in order to obtain a rejection signal indicative of only the defective uncoated region or regions.

It is toward this end that the proximity detector 116 is provided opposite to the lobed wheel 118 on the second drive shaft 88. The lobe 120 on the wheel 118 in constant rotation causes the proximity detector 116 to put out a signal during a prescribed length of time toward the end of the prescribed period of rotation of the can end disk D on the rest 16 in its raised position. As represented in FIG. 6E, the proximity detector 116 may produce the output during one and a half revolutions of the can end disk D immediately before the completion of the coating of the sealing composition thereon.

As will be seen by referring to FIG. 5, the output signals of the photodetector 70 and proximity detector 116 are both directed into the AND gate 138. During the inputting to the AND gate 138 of the photodetector output indicative of the nonfaulty uncoated region, the proximity detector 116 delivers no output to the AND gate, as will be apparent from a study of FIGS. 6D and 6E. The AND gate 138 produces no output during that time, so that the relay 148 remains unactivated. However, if the photodetector 70 produces an output indicative of a faulty uncoated region during output production by the proximity detector 116, the two inputs of the AND gate 138 will be energized simultaneously, and so the AND gate 138 produces an output for delivery to the relay 148 via the holding corcuit 140 and output amplifier 146. The holding circuit 140 functions to hold the relay 148 activated after the cessation of output production by the AND gate 138 until reset by the reset switch 144.

Thus activated, the relay 148 causes energization of the solenoid 134 (FIG. 4) of the rejection means 122 and the consequent opening of the on-off valve 130. Thereupon the air nozzle 128 becomes placed in communication with the pressurized air source 132 and so expels a forced airstream for blowing the faulty can end disk from atop the delivery conveyor 124.

Normally it will take from approximately 0.5 to 1.0 second for each can end disk D to travel from the rest 16 to the position on the delivery conveyor 124 opposite the air nozzle 128. Accordingly, in the illustrated example, the air nozzle 128 starts blowing air immediately upon detection of a faulty uncoated region on the curled rim of the can end disk D on the rest 16 by the photodetector 70 and continues to do so for two seconds. It is possible in this manner to automatically and positively reject any can end disk on which a faulty uncoated region has been detected, no matter how small it may be.

Upon completion of the coating of the can end disk D, with the concurrent detection of any uncoated region thereon, the rest 16 is lowered for unloading of the coated disk therefrom and for loading of a new disk thereon, by the reciprocating feed bars 12 with the separator blades 24 and push fingers 26. Thereafter the apparatus repeats the foregoing cycle of operation.

Although the present invention has been disclosed with respect to one embodiment thereof, it is to be understood that modifications can be made without departing from the scope of the invention defined in the claims. For example, although in the embodiment of the invention illustrated, the rotary rest is caused to move up and down, it may be stationary vertically, and instead the holddown member may be caused to move up and down to press the can end disk against the rest.

What is claimed is:

1. In apparatus for applying a coat of a sealing composition on annular, curled rims of can end disks, including a rotary rest for holding thereon one can end disk at a time for joint rotation therewith, and a nozzle supported in a first preassigned angular position over the curled rim of the can end disk on the rest for dispensing each predetermined quantity of the sealing composition, each can end disk having its curled rim coated with the sealing composition from the nozzle while being rotated a prescribed number of revolutions on the rest, a system for detecting the improper coating of the sealing composition on the curled rims of the can end disks, the detecting system comprising:

(a) a photodetector disposed in a second preassigned angular position over the curled rim of the can end disk on the rest for detecting uncoated regions on the curled rim of the can end disk on the rest while the can end disk is in rotation with the rest and is being coated with the sealing composition from the nozzle, the photodetector putting out a first signal indicative of uncoated regions on the curled rim of the can end disk, the uncoated regions detected by the photodetector including both faulty and nonfaulty uncoated regions, a nonfaulty uncoated region being one which is not yet coated with the sealing composition, a said first signal indicative of a nonfaulty uncoated region being generated during the passage relative to the photodetector of a peripheral region of the curled rim which is ahead, with respect to a direction of rotation of the rotary rest, of a spot of the curled rim to which the sealing composition is first applied from the nozzle;

(b) a signal generator for putting out a second signal during a prescribed length of time toward the end of the prescribed period of rotation of the can end disk on the rest after the generation of the first signal indicative of the nonfaulty uncoated region has ended; and (c) circuit means for processing the first and second signals for invalidating that portion of the first signal which represents the nonfaulty uncoated region in order to obtain a rejection signal which represents only a faulty uncoated region, if any, on the curled rim of the can end disk on the rest, said circuit means comprising an AND gate having input terminals receiving said first and second signals from said photodetector and said signal generator, respectively, said AND gate generating the rejection signal only when it receives concurrently the second signal and the first signal indicative of a faulty uncoated region.

2. The apparatus of claim 1 wherein the signal generator is a proximity detector.

3. The apparatus of claim 1, wherein the second preassigned angular position of the photodetector is spaced 180° from the first preassigned angular position of the nozzle.

* * * * *